US006220488B1

(12) United States Patent
Seickel et al.

(10) Patent No.: US 6,220,488 B1
(45) Date of Patent: Apr. 24, 2001

(54) CRUSH PROTECTION DEVICE FOR HANGER SUPPORTED CLOTHING

(76) Inventors: Joseph Seickel, 1898 Woodland Ter., Bridgewater, NJ (US) 08805; Charles A. Krieger, 60 E. End Ave., New York, NY (US) 10028

( * ) Notice: Subject to any disclaimer, the term of this patent is extended or adjusted under 35 U.S.C. 154(b) by 0 days.

(21) Appl. No.: 09/643,886

(22) Filed: Aug. 23, 2000

Related U.S. Application Data

(60) Provisional application No. 60/150,957, filed on Aug. 27, 1999.

(51) Int. Cl.[7] ..... A47G 25/14
(52) U.S. Cl. ..... 223/87; 223/98
(58) Field of Search ..... 223/87, 98, 85, 223/92

(56) References Cited

U.S. PATENT DOCUMENTS

| | | | | |
|---|---|---|---|---|
| 839,285 | * | 12/1906 | Gerachi | 223/87 |
| 1,251,461 | * | 1/1918 | Bachmann | 223/87 |
| 1,638,945 | * | 8/1927 | London | 223/87 |
| 1,850,169 | * | 3/1932 | De Fay | 223/87 |
| 1,878,771 | * | 9/1932 | Goldsmith | 223/87 |
| 2,649,229 | * | 8/1953 | Sutter | 223/87 |
| 4,658,997 | * | 4/1987 | Nash | 223/98 |
| 5,577,645 | * | 11/1996 | Seitz | 223/87 |

* cited by examiner

*Primary Examiner*—Bibhu Mohanty
(74) *Attorney, Agent, or Firm*—Charles E. Temko

(57) ABSTRACT

A crush resistant device for enclosing the shoulder portions of a hanger-supported garment to prevent wrinkling of the garment when packed in compressive relation with adjacent garments in a shipping container, thereby avoiding wrinkling of the enclosed portion of the garment during storage and shipping.

3 Claims, 2 Drawing Sheets

CRUSH PROTECTION DEVICE FOR HANGER SUPPORTED CLOTHING

The application claims benefit of Provisional Application Ser. No. 60/100,967 filed Aug. 27, 1999.

BACKGROUND OF THE INVENTION

This invention relates generally to the field of garment packaging, and more particularly to an improved crush resistant device adapted to surround and reinforce the shoulder and sleeve portion of a garment suspended upon a hanger, the hanger being supported within a packing crate or container for shipment from a place of manufacture to a customer.

In recent years, the amount of clothing sold in the United States of foreign manufacture has escalated dramatically. Such garments are normally transported by land and sea using large containers which are loaded with as many garments as possible, in order to maintain shipping costs as low as practicable. Before loading, the garments are carefully pressed. However, when the garments are loaded in the shipping container, compressive forces transmitted by adjacent garments, particularly in the area of the supporting hangers, often result in the wrinkling of the shoulder and sleeve areas, so that after unloading, the garment must be at least partially repressed before further distribution, requiring additional relatively high cost labor to restore the garment to presentable condition.

SUMMARY OF THE INVENTION

Briefly stated, the invention contemplates the provision of means for eliminating or at least substantially ameliorating the above-described problem. To this end, the disclosed embodiment comprises a semi-rigid compression resistant shield preferably formed of fibrous planar material forming an elongated recess enabling the enclosure of a pressed garment supported upon a clothes hanger in the area of the shoulder and sleeve portions to be supported in position by the hanger such that when compressive forces are exerted upon the garment in a plane normal to the lateral axis of the hanger, the shield will distribute such forces in a manner to effectively prevent wrinkling of the garment during the continuation of such forces over an extended period of time. Most conveniently, the device is formed as a die stamping of planar thin-gauged cardboard which is subsequently folded and interconnected to an elongated loop-shaped configuration. The end walls of the device are formed from bendable tabs extending from the side walls, so as to present a multiple thickness of material providing additional resistance to compressive forces. The device may be configured to be used both inside and outside the garment, and may also be used to display a garment as well.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 5:
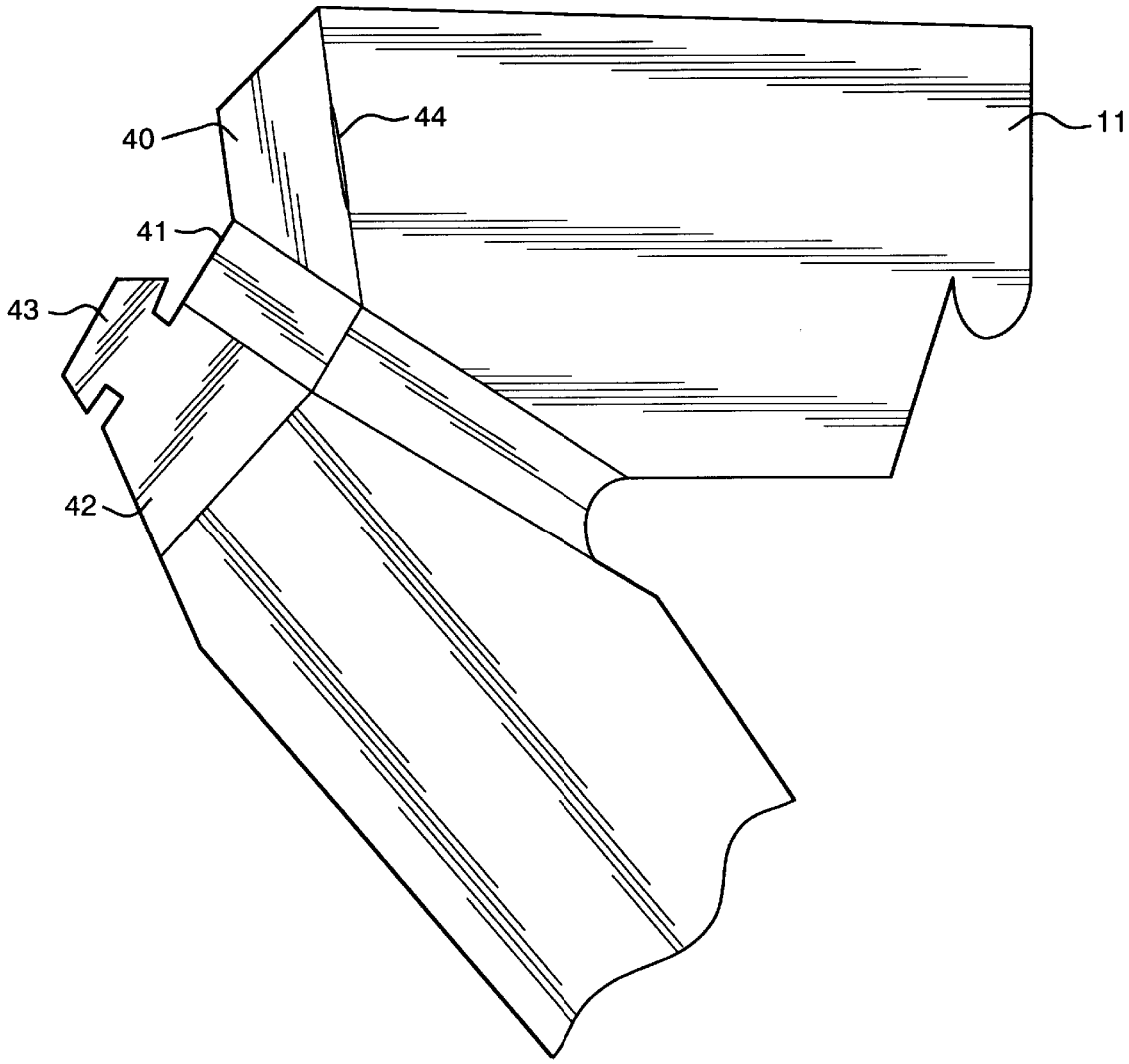
FIG. 5 is a fragmentary development of the embodiment prior to assembly.

In accordance with the invention, the device, generally indicated by reference character 10, comprises a single blank of relatively lightweight fibrous material 11 (FIG. 5) which, in assembled condition, includes first and second side walls 13 and 14, first and second upper walls 15 and 16, and first and second end walls 17 and 18 which in interconnected condition, define an upper continuous opening 19 and a lower continuous opening 20.

The side walls 13 and 14 are substantially congruent, each being bounded by an upper rectilinear edge 22, a lower rectilinear edge 23, end edges 24 and 25, and angularly-oriented edges 26 and 27.

The upper members 16 and 17 are angularly-oriented, being bounded by first and second edges 30 and 31, and end edges 32 and 33.

Figure 1:
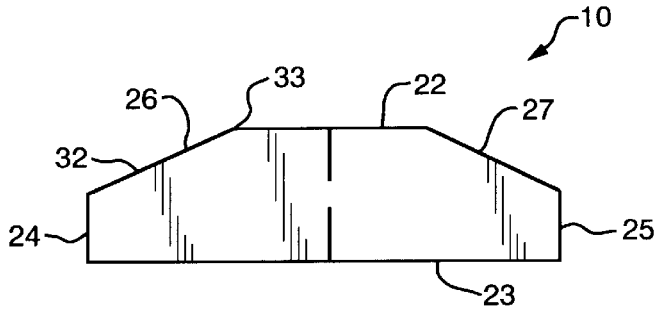
FIG. 1 is a side elevational view of an embodiment of the invention.
Figure 2:
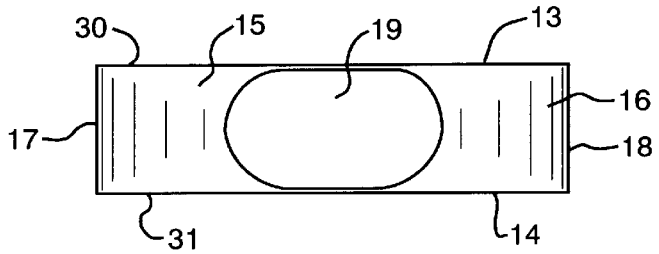
FIG. 2 is a top plan view thereof.
Figure 3:
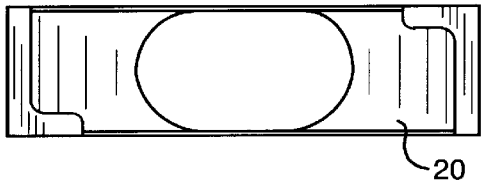
FIG. 3 is a bottom plan view thereof.
Figure 4:
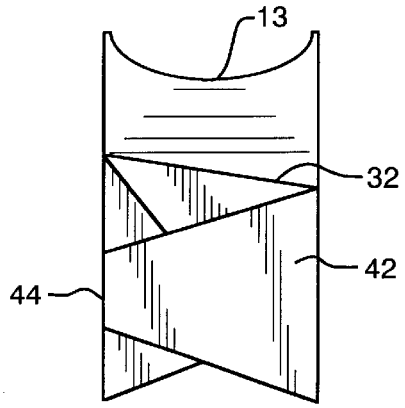
FIG. 4 is an end elevational view thereof.

The end walls 17 and 18 are each formed by first, second and third flanges 40, 41, and 42 respectively, the flange 42 being provided with an interlocking tab 43 which cooperates with a slot 44. When assembled, the end walls are of triple thickness, thus providing increased resistance to compressive forces at the lateral ends of the device (See FIG. 4).

FIGS. 1 through 4 illustrates the device in assembled condition. A hanger with supported garment (not shown) projects through the upper opening 19 to enable the upper wall members 15 and 16 to be supported by the garment which is, in turn, supported by the hanger. The lower opening will surround the garment at a level approximately three to four inches below the upper edge of an arm scye on each side of the garment.

When the garment and supporting hanger are packed in suspension within a container, pressure will be applied to the side walls through adjacent garments which will resist compression because of the presence of the upper walls and the side walls. In addition, the side walls will spread any localized compressive forces so that there will be no small area of compression which will result in wrinkling of the garment therebeneath.

It may thus be seen that we have invented novel and highly useful improvements in a garment shield device which effectively prevents the crushing of the shoulder portions of a garment suspended upon a hanger within a shipping container which might result in wrinkling of the garment. The device is preferably manufactured from planar fibrous material, typically, lightweight cardboard s a result of a single die cutting operation, at a cost permitting it to e discarded after a single use. The device is assembled and installed using only ordinary skills within a very short period of time.

We wish it to be understood that we do not consider the invention to be limited to the precise details of structure shown and set forth in the specification, for obvious modifications will occur to those skilled in the art to which the invention pertains;

We claim:

1. A crush resistant shield for preventing the wrinkling of a hanger-supported garment in the area of the shoulder portions of said garment during storage within a shipping container, said shield comprising a single blank of fibrous material, foldable to form a pair of elongated side walls, a pair of end walls, and a pair of converging upper walls, and defining an elongated cavity surrounding said shoulder portions; said upper walls defining an opening for the projection of a central portion of a garment supporting hanger wherein said shield is supported in position by laterally-extending portions of said hanger; said side and upper walls defining a lower opening through which said supported garment projects.

2. A shield in accordance with claim 1, said end walls being formed by overlying flaps extending from said side and upper walls in such manner as to include multiple thickness compared to the thickness of said side walls.

3. A shield in accordance with claim 1, wherein localized compressive forces applied laterally inwardly of said end walls against said side walls are distributed over an inner surface of said side wall to prevent localized wrinkling of said garment.

* * * * *